United States Patent [19]

Steadman

[11] 4,242,726

[45] Dec. 30, 1980

[54] ELEVATED LIGHT SYSTEM

[76] Inventor: Rufus P. Steadman, Rte. 2, Box 249, Middleton, Tenn. 38052

[21] Appl. No.: 37,976

[22] Filed: May 10, 1979

[51] Int. Cl.[3] ..... F21V 19/02

[52] U.S. Cl. ..... 362/418; 362/431

[58] Field of Search ..... 362/418, 431

[56] References Cited

U.S. PATENT DOCUMENTS 4,064,432 12/1977 Compton et al. ..... 362/431

*Primary Examiner*—Stephen J. Lechert, Jr.

*Attorney, Agent, or Firm*—Millen & White

[57] ABSTRACT

An assembly for supporting a light or other signal fixture in elevated position on a standard, such as a tower or pole structure in street and highway lighting, and for lowering the fixture along the standard to a lower position accessible to service personnel for repair, replacement or other servicing of the fixture; the assembly including a carriage for the fixture with a support and actuating connection to a lower accessible location generally following the contour configuration of the standard and at which lower accessible location, service personnel may manipulate the connection for lowering and raising the fixture.

14 Claims, 3 Drawing Figures

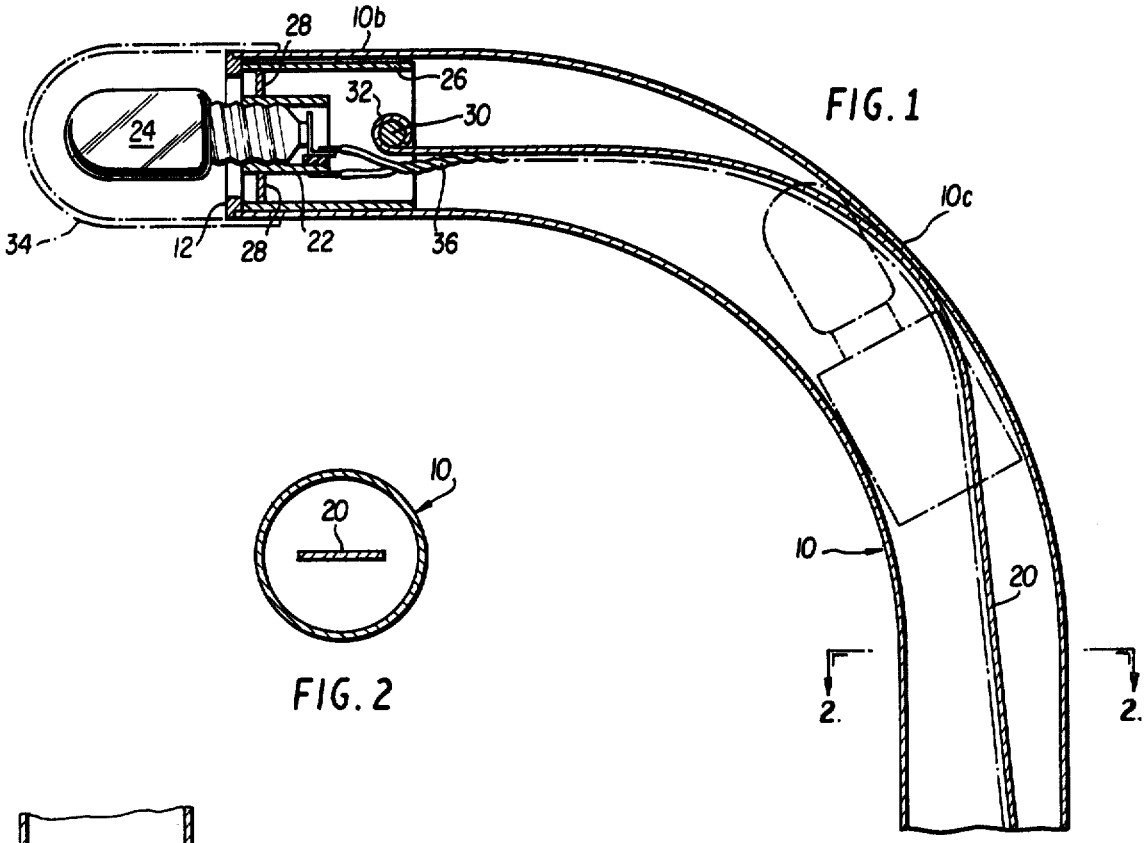
FIG. 1
FIG. 2
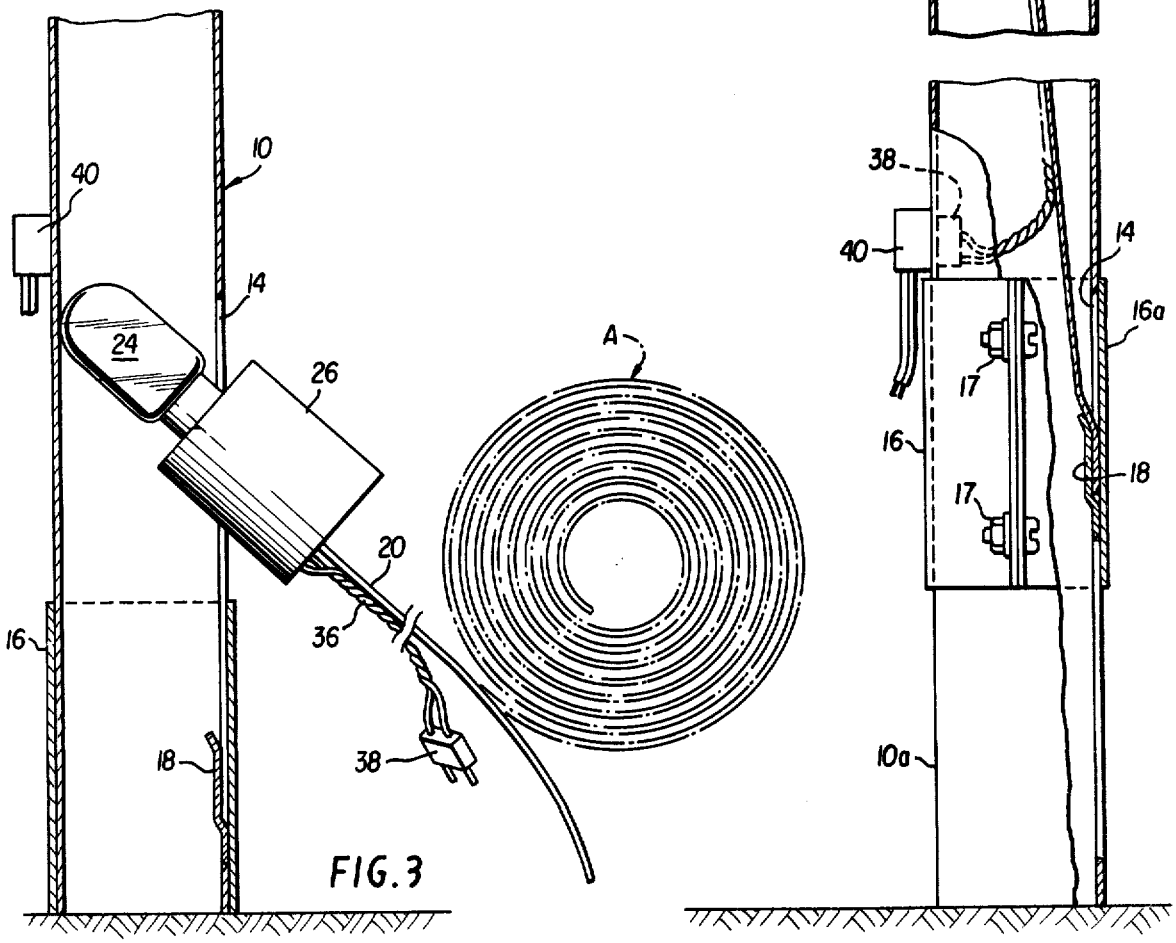
FIG. 3

ELEVATED LIGHT SYSTEM

BACKGROUND OF THE INVENTION

The invention is concerned with elevated lighting or other signal fixtures at the top portion of a supporting standard, as a tower or pole structure in street and highway lighting. Repair, replacement or servicing of such fixtures often involves the necessity for service personnel to gain access to the fixture at its elevated position, as by climbing or with use of a service truck equipped with a maneuverable elevator for the service personnel. Under these conditions, unitized replacement fixtures mounted at the elevated position have been provided (U.S. Pat. No. 3,679,891); and to obviate the necessity of service personnel gaining access to the elevated position of the fixture for repair, replacement or other servicing thereof, cable and like mechanisms have been provided for lowering and elevating the fixture to a lower accessible position for service personnel (U.S. Pat. Nos. 3,292,322; 3,686,498; 3,856,639). The mechanisms are relatively expensive and exposed, thus being subject to exteriorly applied damage as well as weather conditions. My copending application, Ser. No. 005,757, filed Jan. 23, 1979, shows another assembly for moving a light or other signal fixture between an elevated operative position and a lower accessible position for servicing.

SUMMARY OF THE INVENTION

According to the assembly of the present invention, there is provided a standard for a light or other signal fixture at an elevated portion thereof, as in street or highway lighting, and the fixture is connected to a substantially incompressible and non-stretchable actuating and support element which is flexible without kinking along its length and highly resistant to torsional twisting along its length. Examples of such actuating and support elements are in the nature of so-called plumbers' snakes or sewer rods which may be of the Bowden cable type with a central core and exterior helical windings (U.S. Pat. Nos. 2,244,735; 2,631,113) or of a flat tempered spring steel type which may be coiled or which is tempered to assume a light relaxed coil (U.S. Pat. Nos. 834,135; 2,488,490). The fixture is mounted to a carriage which is connected to the actuating and support element which, in turn, extends along the standard and is laterally confined thereby to a greater or lesser degree permitting manipulation of the element at a lower accessible position by service personnel to lower the fixture for repair, replacement or other servicing, including periodic washing as required by regulations, and to then elevate the fixture to its operative position at an elevated portion of the standard.

An object of the invention is to provide an assembly substantially of the above type which obviates the necessity for service personnel gaining access to the elevated location of the fixture for repair, replacement or other servicing by providing a manipulative connection between the fixture and a lower location accessible to service personnel for lowering and elevating the fixture along the standard.

Another object of the invention is to provide an assembly substantially of the above type wherein the connection between the fixture and the lower accessible location is in the form of a substantially incompressible actuating and support element to maintain the fixture in elevated operative position but of sufficient flexibility to generally follow the standard configuration during elevating and lowering of the fixture.

A further object of the invention is to provide an assembly substantially of the above type wherein the configuration of the standard is such as to confine movement of the actuating and support element in its association therewith along the length thereof as it is manipulated to effect raising and lowering of the fixture.

The above and other objects of the invention will in part be obvious and will be hereinafter more pointed out in the description of the drawings in which:

FIG. 1 is a side elevation of the standard and included fixture and actuating element;

FIG. 2 is a sectional view taken along the line 2—2 of FIG. 1; and

FIG. 3 is a fragmentary elevation of the lower portion of the standard showing withdrawal of the actuating element and fixture through the access opening.

With reference to the accompanying drawings, and particularly FIG. 1 at this time, the standard in the form of a tower or pole structure 10 has the lower end portion **10*a* in stabilized ground level support. The standard may assume various heights and configurations as used in street and highway lighting and is illustrated as including an upper portion 10*b* curved laterally, as at 10*c*, from the axis of the major upright portion of the standard. Also, the standard is illustrated as of tubular configuration formed of steel, aluminum or a suitable plastic material, e.g., a polycarbonate. The tubular configuration may be substantially constant or it may be given a slightly reduced taper toward the upper portion thereof which is provided with an annular plate 12 providing an inward flange serving as a stop or abutment locating the fixture in operative position. The supported lower end of the standard is provided with an access opening 14 through which the light may be cleaned or the fixture removed for repair, replacement or other servicing. This opening is controlled by a closure member suitably mounted to the standard. As illustrated, the closure is in the form of sections 16, 16*a* conforming to the adjacent configuration of the standard and secured together by screw or like fasteners 17 covering the opening. These fasteners may be loosened to permit movement of the closure relative to the standard for exposing the access opening 14. As shown in dotted position of FIG. 1, the closure member is slipped downwardly to expose the opening. In doing so, the open-ended upright bracket 18 in the section 16*a* releases the lower end of the actuating member 20**, which was previously latched and supported thereby in elevated position.

The fixture includes a threaded socket 22 receiving lamp 24 suitably attached to a carriage 26 illustrated as cylindrical with internal struts or flange means 28 suitably attached to the socket. At the rear end of the sleeve portion of the carriage, there is provided a transverse pin 30 to which the end of the actuating element is pivotally attached as by a looped portion 32. While an outer lamp casing 34 is shown in dotted lines in FIG. 1 attached to the end of the standard, this may be eliminated as well as a separate reflector and the lamp 24, itself, may be of the sealed beam type with an included reflecting surface as desired. Thus, such a lamp can be withdrawn with the carriage, the opening in the flange 12 being sized for this purpose, and the flanges 12, 28 may be provided with suitable sealing around the socket and carriage excluding weather elements. An electric cord connection 36 extends from the socket along the actuating element and through an aperture therein, as shown, for plug 38 connection with an electric power source 40 for energizing the light or other fixture.

The actuating and support element 20 is shown as a flat strip of spring steel of a width to resist torsional twisting and the interior surfaces of the tubular standard will engage the strap at surface locations intermediate the length thereof to prevent any tendency toward kinking or reverse curvature of the strip during its operation in elevating the fixture and holding the same in operative positon at the upper end of the standard. The width of the strip 20 and its extended engagement with the transversely extending pin 30 is such as to orient the light fixture and its reflecting surface for proper light dispersion, as intended, although inner surface guide means may be provided between the carriage and inner surface of the portion 10*b* if desired, and with such an arrangement, a core and coil Bowden type actuating element might be employed.

In operation, the closure 16, 16*a*, is moved downwardly to the position of FIG. 3 to expose the opening 14, or the section 16*a* may be removed or hinged outwardly for this purpose. The transverse latching bracket is thus released from engagement with the end of the actuating element 20, or from a lower latch engaged portion thereof, and service personnel may withdraw the actuating element laterally outwardly through the opening 14. The strip 20 may be played out or it may have been tempered to assume a relaxed self coiling as shown at A in FIG. 3. During such withdrawal, the lamp will pass through the flange plate 12 in following the carriage as it is pulled downwardly within the standard. The width or peripheral dimensioning of the carriage is of a predetermined degree less than the inner dimension of the tubular standard to negotiate the curved portion 10*c* as shown in dotted lines in FIG. 1. Likewise, the access opening 14 is dimensioned relative the pertinent dimensions of the lamp and carriage to enable the fixture to be canted for removal through the access opening as also shown by dotted lines in FIG. 3. Repair, replacement or other servicing of the fixture or lamp may thus be accomplished at ground level by service personnel. Upon such repair or other servicing, the fixture is reinserted into the standard and the actuating and support strip is payed in by service personnel to elevate the fixture to its operative position at the top of the standard. In doing so, the strip, or other incompressible actuating element may tend to transversely flex but such flexing will be confined by the inner surface of the tubular standard even though it may take a gradual wavy configuration as shown by the dotted positioning of the strip 20 in FIG. 1. If desired, such a configuration may be maintained in the strip when the fixture reaches its operative position so that the substantially horizontal component of the upper portion of the strip will exert a substantially straight line strut action against the fixture to render any sealing more effective. To this end, the location of the latching bracket 18 may be selectively positioned in the region of the opening in relation to the known length of the actuating strip for imposing a desired force in the direction of compression along the length of the actuating strip.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a composite assembly of an elevated and stabilized standard, as a tower or pole structure to carry a light or other signal fixture for street and highway lighting; the provision of a carriage carrying the fixture and associated with the standard for movement substantially along the length thereof between a lower accessible position permitting repair, replacement or other servicing of the fixture and an upper position with the fixture in operative location; and elongate actuating means with permissive lateral flexing connected to the carriage and extending from the upper position thereof along the standard in at least partially laterally confined association therewith to a lower accessible position for service personnel to manipulate the same for lowering and raising the carriage with the included fixture.

2. In the assembly of claim 1, wherein the standard is generally tubular with an access opening in the lower portion thereof and wherein the actuating means is disposed substantially entirely within the tubular standard.

3. In the assembly of claim 1, wherein the actuating means is substantially incompressible for supporting the carriage and included fixture but with permissive predetermined lateral flexing without kinking during manipulation thereof.

4. In the assembly of claim 3, wherein the actuating means is pivotally connected to the carriage permitting the carriage to follow the standard configuration during movement thereof between upper and lower positions.

5. In the assembly of claim 4, wherein the actuating means comprises an elongate flat strip of spring steel resistant to torsional twisting.

6. In the assembly of claim 5, wherein the standard is generally tubular with a lateral opening in the lower portion thereof for access to the fixture and for withdrawal of the actuating strip in lowering the fixture.

7. In the assembly of claim 6, wherein the upper end of the standard includes an inward peripheral flange serving as an abutment to locate the fixture in its upper operative position when elevated by the actuating strip.

8. In the assembly of claim 7, wherein the carriage is relative dimensioned inwardly of the inner surface of the tubular standard to negotiate any curvature of the standard during raising and lowering of the carriage and fixture therein.

9. In the assembly of claim 8, wherein a closure member is carried by the standard and movable relative thereto for opening and closing the access opening, and wherein the closure member carries a latching shoulder receptive to a portion of the actuating strip when the carriage and fixture are in elevated position for latching the strip under compressive force to hold the carriage and fixture in operative elevated position.

10. In the assembly of claim 1, wherein the standard is in the form of a generally tubular upright with a curved laterally extending upper end portion, and wherein the carriage is of a predetermined peripheral dimension to negotiate the interior surface of the curved upper end portion of the tubular upright and with the light fixture being not greater than said predetermined dimension to also negotiate the curved upper end portion of the upright during movement thereof along the upright between upper and lower positions, and wherein the actuating means comprises a substantially incompressible and non-stretchable elongate element resistant to torsional twisting and flexible kinking for locating the carriage and fixture in proper orientation at the elevated operative position thereof, and wherein there is provided an access opening at the lower end of said tubular upright and through which the actuating means may be flexed and withdrawn for lowering the carriage and fixture and reinserted for elevating the same to operative position, and wherein latch means are provided in the region of the access opening for engaging the actuating element with the carriage and fixture in operative position to selectively locate the actuating element relative the interior surfaces of the tubular upright for exerting predetermined compressive force thereon for holding the carriage and fixture in secure operative position.

11. In the assembly of claim 1, wherein the actuating means is a substantially incompressible push-pull mechanism with at least intermediate portions thereof confined by the standard during movement of the carriage and included fixture between upper and lower positions.

12. In the assembly of claim 11, wherein the carriage is configured for guidance by the standard substantially throughout the length thereof during movement between upper and lower positions.

13. In the assembly of claim 12, wherein the actuating means is flexed and guided in its confinement by the standard at least during elevating movement of the carriage and fixture from the lower to the upper operative position.

14. In the assembly of claim 13, wherein the standard is generally hollow for confining and guiding the actuating means.

* * * * *